US008718303B2

(12) United States Patent
Rank et al.

(10) Patent No.: US 8,718,303 B2
(45) **Date of Patent: *May 6, 2014**

(54) HEARING AID SYSTEM FOR ESTABLISHING A CONVERSATION GROUP

(75) Inventors: Mike Lind Rank, Farum (DK); Jakob Nielsen, Copenhagen (DK); Michael Ungstrup, Allerod (DK); Kristian Thygesen Gjesse, Valby (DK)

(73) Assignee: Widex A/S, Lynge (DK)

( * ) Notice: Subject to any disclaimer, the term of this patent is extended or adjusted under 35 U.S.C. 154(b) by 703 days.

This patent is subject to a terminal disclaimer.

(21) Appl. No.: 12/636,098

(22) Filed: Dec. 11, 2009

(65) Prior Publication Data

US 2010/0086152 A1 Apr. 8, 2010

Related U.S. Application Data

(63) Continuation-in-part of application No. PCT/DK2008/050140, filed on Jun. 13, 2008.

(30) Foreign Application Priority Data

Jun. 13, 2007 (WO) ..... PCT/DK2007/050071

(51) Int. Cl.
*H04R 25/00* (2006.01)

(52) U.S. Cl.
USPC ..... 381/315; 381/312

(58) Field of Classification Search
USPC ..... 381/312–331
See application file for complete search history.

(56) References Cited

U.S. PATENT DOCUMENTS

| | | | | |
|---|---|---|---|---|
| 4,548,082 | A | 10/1985 | Engebretson et al. | |
| 5,721,783 | A | 2/1998 | Anderson | |
| 6,696,973 | B1 | 2/2004 | Ritter et al. | |
| 6,879,695 | B2 * | 4/2005 | Maltan et al. | 381/315 |
| 2002/0128030 | A1 | 9/2002 | Eiden et al. | |
| 2003/0133582 | A1 | 7/2003 | Niederdrank | |
| 2005/0157896 | A1 | 7/2005 | Maltan et al. | |

(Continued)

FOREIGN PATENT DOCUMENTS

| | | | |
|---|---|---|---|
| EP | 1460769 | A1 | 9/2004 |
| EP | 1643801 | A2 | 4/2006 |

(Continued)

OTHER PUBLICATIONS

International Search Report Apr. 9, 2008 for PCT/DK2008/050140.

(Continued)

*Primary Examiner* — Matthew Eason
(74) *Attorney, Agent, or Firm* — Sughrue Mion, PLLC

(57) ABSTRACT

A hearing aid system adapted for establishing a conversation group with other hearing aid systems used by different users, comprises a hearing aid (1, 2, 3, 4, 5) with an associated relay device (11, 12, 13, 14, 15). The relay device is (11, 12, 13, 14, 15) adapted for wireless communication (21, 22, 23, 24, 25) with said hearing aid and for wireless communication (31, 32, 33, 34, 35) with a second hearing aid system. The relay device (11, 12, 13, 14, 15) is also adapted for receiving and displaying information about said second hearing aid systems being available for participation in said conversation group, and it comprises means for selection of said other hearing aid systems for inclusion into the conversation group. The invention further provides a method for establishing a conversation group among hearing aid users.

20 Claims, 3 Drawing Sheets

(56) References Cited

U.S. PATENT DOCUMENTS

| | | | | |
|---|---|---|---|---|
| 2006/0039577 | A1 | 2/2006 | Sanguino et al. | |
| 2006/0067550 | A1 | 3/2006 | Puder et al. | |
| 2008/0123865 | A1 | 5/2008 | Beck | |
| 2008/0200159 | A1* | 8/2008 | Lai | 455/416 |

FOREIGN PATENT DOCUMENTS

| | | | |
|---|---|---|---|
| EP | 1657958 | A1 | 5/2006 |
| EP | 1915031 | A2 | 4/2008 |
| JP | 2002261702 | A | 9/2002 |
| JP | 2006-13719 | A | 1/2006 |
| JP | 2006050028 | A | 2/2006 |
| JP | 2006-72812 | A | 3/2006 |
| WO | 0028783 | A1 | 5/2000 |
| WO | 0028784 | A1 | 5/2000 |
| WO | 2006074655 | A1 | 7/2006 |
| WO | 2006133158 | A1 | 12/2006 |

OTHER PUBLICATIONS

International Preliminary Report on Patentability Sep. 9, 2009 for PCT/DK2008/050140.

International Search Report Jun. 18, 2008 for PCT/DK2007/050070.

Opinion International Searching Authority for PCT/DK2007/050070.

Office Action for JP2009-538590 dated Oct. 25, 2011, with English translaiton.

OA for Japanese Application JP2010-509683 dated Apr. 3, 2012.

* cited by examiner

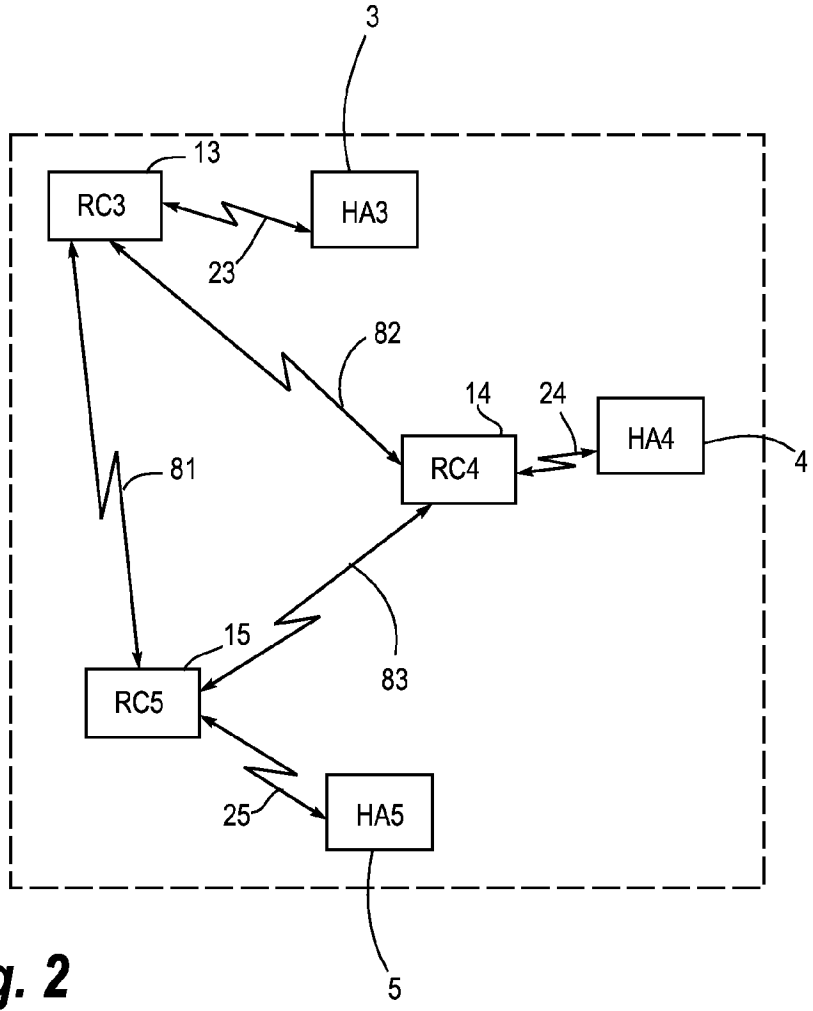
Fig. 2
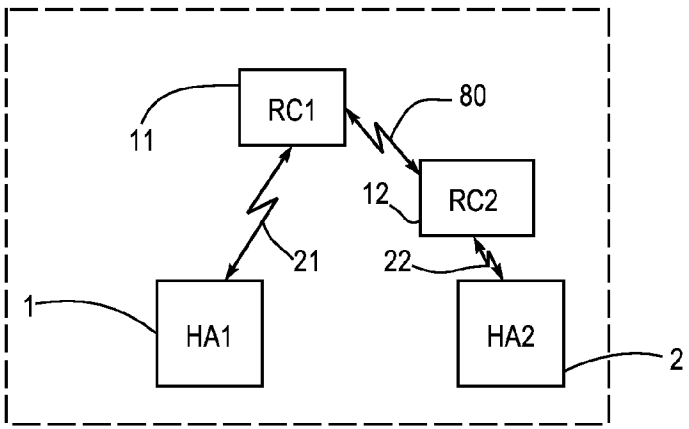

HEARING AID SYSTEM FOR ESTABLISHING A CONVERSATION GROUP

RELATED APPLICATIONS

The present application is a continuation-in-part of application No. PCT/DK2008050140, filed on Jun. 13, 2008, in Denmark and published as WO 2008151638 A1.

The present application is based on and claims priority from PCT/DK2007050071, filed on Jun. 13, 2007 in Denmark, the contents of which are incorporated hereinto by reference. This application is now abandoned.

BACKGROUND OF THE INVENTION

1. Field of the Invention

The present invention relates to hearing aids. The invention, more specifically, relates to a system for establishing a conversation group among a number of hearing aids used by different users. The invention further relates to a method of establishing a conversation group.

2. The Prior Art

In many situations small groups of people have to communicate in noisy environments. This may be at a party or a conference where people gather for conversation in pairs or small groups in a larger room. It may also be in a dining room or cafeteria where people gather around different tables. It could also be a recreational living room in an old people's home, where some people may be watching television, some may be small talking, while others sit around a table playing cards or the like.

In such situations the external noise may be a problem, and each of such pairs or small groups of people may have a distinct interest in enhancing sounds from their own internal conversation, while preferably suppressing any disturbing external noise.

SUMMARY OF THE INVENTION

On this background it is a feature of the present invention to suggest a system and a method for achieving this and overcoming the problems of the prior art.

According to the present invention this feature is achieved by a hearing aid system comprising a hearing aid with an associated relay device, and adapted for establishing a conversation group with other hearing aid systems said relay device being adapted for wireless communication with said hearing aid and for wireless communication with a second hearing aid system, said relay device having means for receiving and indicating information about other hearing aid systems available for participation in said conversation group, and said relay device comprising means for selection of said second hearing aid system for inclusion into said conversation group.

Hereby any sound picked up by a hearing aid participating in the conversation group may be wirelessly transmitted directly to the other participants, without having to travel the full distance through the air. Thus, sound from any speaking person may be picked up by his own hearing aid, located only about 15 centimeters away from his mouth, and transmitted wirelessly to the other hearing aids participating in the conversation group, rather than having to travel up to say one to two meters through the air before being picked up by the microphones of the other hearing aids. The attenuation of the sound before it is picked up, and thus the influence of disturbing noise, is thereby greatly reduced, and the intelligibility of the speech increased. In particular, by using a relay device this less disturbed sound can be transmitted over a longer range than would normally be possible with internal transmitters and receivers of hearing aids. This is because if these transmitters and receivers were to communicate over longer ranges, such as one to three meters or more, the transmitters and receivers would impose a substantial drain on the power source, i.e. the battery, in the hearing aid. Thus, using a relay device allows the use of low power, short range communication of the hearing aid, and higher power communication with other hearing aids or hearing aid systems. The transmitting power and hence the power consumption of the transmitter in the hearing aid can thus be kept at a minimum, because only short range transmission to the relay device is necessary. The relay device on the other hand may generally be larger in size than the hearing aid and thus hold more battery capacity, which in turn allows for more powerful transmission to the shared communication unit.

According to a preferred embodiment of the invention, said system comprises means for detecting the range to said second hearing aid system, and preferably means for automatically selecting said other hearing aid system for inclusion into said conversation group based on range detection. This allows for automated establishment of a conversation group between hearing aid systems of users close to each other, such as in face-to-face communication.

According to an especially preferred embodiment of the invention, said relay device is integrated in a remote control for operating the hearing aid. This is advantageous, because the user of the hearing aid will normally carry the remote control with him anyway. When necessary, the relay device is thus readily available. Moreover the remote control generally has a size allowing for sufficient battery capacity for the transmissions to the shared communication unit, as compared to the hearing aid itself.

According to another preferred embodiment said means for receiving and indicating information about said other hearing aid systems comprises at least one of a display and a means for emitting an audio signal, thereby providing for visual and acoustic indication.

According to another preferred embodiment said relay device is adapted for establishing wireless communication with a Local Area Network. Wireless Local Area Networks have gained wide popularity, inter alia because they are easy to establish and relatively inexpensive. Thus, for many of those locations where it may frequently be advantageous for occupants to establish a conversation group among a number of hearing aids users, the necessary infrastructure may easily be established, if not already present.

According to another preferred embodiment said relay device comprises means for detecting and indicating the presence of said Local Area Network, whereby the user may selectively establish wireless connection with the Local Area Network upon receiving an indication on its presence.

According to a preferred embodiment said means for detecting and indicating the presence of said Local Area Network comprises at least one of a display and means for emitting an audio signal, thereby providing for visual and acoustic indication.

According to yet another preferred embodiment of the invention, said relay device comprises a means for indicating other hearing aids systems having established connection with said Local Area Network, and comprises means for selection of such other hearing aid systems for inclusion into said conversation group. Thereby the users of the hearing aids systems according to the invention may selectively put together an ad hoc conversation group with intended participants based on an indication of the potential participants provided by the relay device. This allows for the exclusion of non-participants who might simply be proximate to someone participating in the conversation group.

According to another preferred embodiment, said means for indicating other hearing aid systems having established connection with said Local Area Network comprises at least one of a display and a means for emitting an audio signal, thereby enabling the relay device to provide for the above mentioned indication in a simple and straight forward manner.

According to another preferred embodiment, said relay device is adapted for establishing direct wireless communication with said other hearing aid systems. This is advantageous because it may allow conversation groups to be formed between any hearing aid systems in their vicinity.

According to a further preferred embodiment, said hearing aid comprises a microphone for picking up sounds in the ear canal of the user. This, preferably additional, microphone is advantageous in extremely noisy surroundings, because in that case the speech of the hearing aid user is picked up in the ear canal, where it is shielded from ambient noise by inter alia the earplug of the hearing aid.

According to yet another preferred embodiment of the invention, said relay device comprises at least one built-in microphone, preferably a directional microphone. This allows a hearing aid user to place his own relay device in front of himself and pointing towards him, so as to have a directional microphone directed to pick-up his speech rather than relying on the built in microphones of his hearing aid. More important however, it would also allow a person not using a hearing aid to participate in the conversation group. For instance he may simply borrow a relay device from one of the other participants and place it in front of himself so as to allow the other hearing aid users to hear his speech via the relay device.

According to a second aspect the present invention further provides a method for establishing a conversation group between a hearing aid system comprising a hearing aid and an associated relay device and at least one other hearing aid system comprising the steps of detecting with said relay device the presence of said other hearing aid systems, available for participation in said conversation group, receiving in said relay device information about said other hearing aid systems, indicating said presence of said other hearing aid systems by the use of said relay device, and selecting, using said relay device, at least one of said other hearing aid systems for participation in said conversation group.

BRIEF DESCRIPTION OF THE DRAWINGS

The invention will now be described in greater detail based on non-limiting exemplary embodiments and with reference to the schematic drawings. In the drawings, FIG. 1 schematically illustrates a situation where a number of hearing aid systems according to the invention have formed two conversation groups using a wireless Local Area Network;

FIG. 2 schematically illustrates a situation where a number of hearing aid systems according to the invention have formed two conversation groups using direct communication.

DETAILED DESCRIPTION OF THE INVENTION

Figure 1:
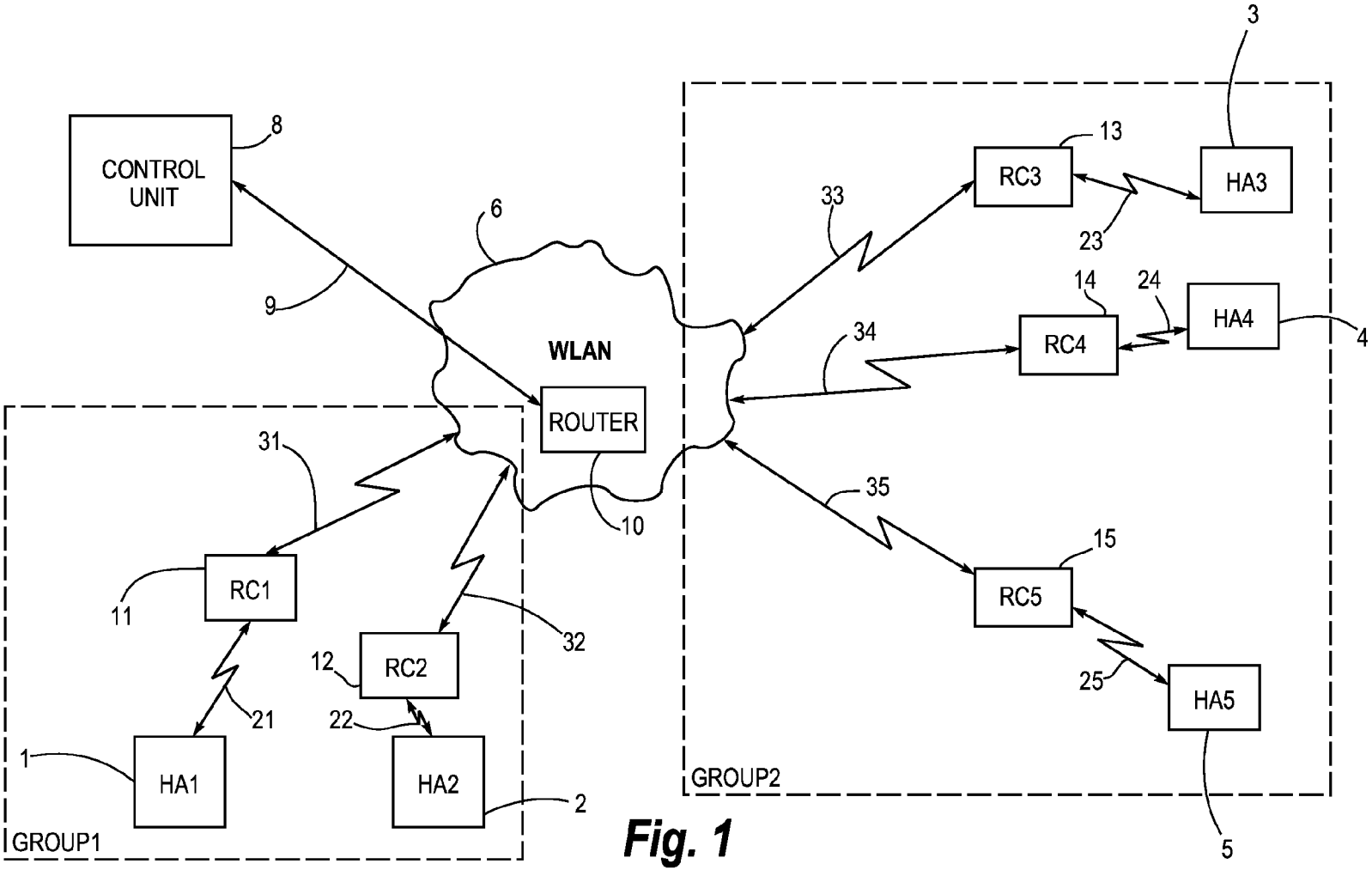

In both FIGS. 1 and 2, a number of hearing aids HA1, HA2, HA3, HA4 and HA5, referenced 1, 2, 3, 4, 5, respectively, are illustrated. To each of the hearing aids 1, 2, 3, 4, 5 there is associated a respective relay device RC1, RC2, RC3, RC4 and RC5, referenced 11, 12, 13, 14, 15, respectively, thereby forming a corresponding number of hearing aid systems according to the invention. The hearing aids shown only schematically, 1, 2, 3, 4, 5, may be single hearing aids or binaural systems, in which two hearing aids share one single respective relay device 11, 12, 13, 14, 15. In the figures the number of illustrated hearing aid systems is five, which suffices for illustration purposes, but in practice there may be any number.

The communication between each of the hearing aids 1, 2, 3, 4, 5 and its respective relay device 11, 12, 13, 14, 15 takes place via an individualized wireless transmission 21, 22, 23, 24, 25. The wireless transmissions 21, 22, 23, 24, 25 are bi-directional and operate at low power, giving them only a short range. Typically the range is less than one to two meters, so as not to disturb other wireless transmissions 21, 22, 23, 24, 25 between hearing aid systems in the vicinity transmitting on the same frequency, e.g. a corresponding hearing system of another person to whom a user is talking face-to-face. It is presently preferred to use simple spatial separation, i.e. by relying on each transmission being of so low power that it is unlikely to disturb other transmission, which is spaced there from because there is a natural limit to how close people normally let other people physically get to them. However, the skilled person will realize that other means of avoiding wireless transmissions disturbing each other exist. Examples of such are temporal separation, where transmission takes place in assigned time-slots, or frequency separation, where transmissions take place on different assigned frequencies, or a combination of both. An example of such a low power relay system is found in WO-A-2006/074655. In this system the relay device is a remote control communicating bi-directionally with a computer, allowing audio to be streamed to the hearing aid from the computer.

FIG. 1 further illustrates that the relay devices 11, 12, 13, 14, 15 communicate wirelessly with a router 10 of Local Area Network 6 using respective communication links 31, 32, 33, 34, 35. The wireless connection to the Local Area Network is preferably based on one of the IEEE 802.11a/b/g standards, but other wireless access to the Local Area Network may be envisaged.

Wireless Local Area Networks or WLANs based on the IEEE 802.11a/b/g standards have found wide use in private homes and public spaces, and routers for providing such wireless Local Area Networks are readily available commercially at low prices. The router 10 has a maximum effective range of approximately 10-100 meters, e.g. 30 meters. Communication via the router 10 thus greatly enhances the range available as compared to a direct link.

Generally, in this description the term "Local Area Network" implies that a given area is provided with coverage in terms of wireless communication by at least one base unit such as a wireless router as described above or any other suitable wireless access means. Furthermore, when a component is referred to as "present on the Local Area Network", it is understood, that the component has performed a handshake procedure with the base unit.

Moreover, in FIG. 1 it is indicated with interrupted lines that two conversation groups have been established. One conversation group comprises the relay devices 11 and 12 of the respective hearing aids 1 and 2, the relay devices 11, 12 communicating with each other via the wireless Local Area Network 6. The other, totally independent conversation group comprises the relay devices 13, 14, 15 of the hearing aids 3, 4, 5, where the relay devices 13, 14, 15 communicate with each other via the same wireless Local Area Network 6.

In the following part of the description reference will be made to the hearing aid system based on hearing aid 1. The skilled person will understand that, as far as not stated otherwise, the description will apply likewise to the other hearing aid systems comprising the hearing aids 2, 3, 4 or 5.

When the hearing aid system according to the invention is within range of a wireless Local Area Network, such as WLAN 6 in FIG. 1, this will be detected by the hearing aid system, more specifically by the relay device 11. The presence of the Local Area Network is preferably indicated to the user on a display 7 of his relay device 11, allowing him to connect to it. If several Local Area Networks are present at the same time he may select an appropriate one of them. If the user frequently moves around between several specific wireless Local Area Networks, say at home and at work, an automatic and prioritised connection may be provided. I.e. when he is within reach of his own home Local Area Network he may automatically be connected, without having to choose between his own and e.g. the Local Area Network of the neighbour.

Alternatively the presence of the Local Area Network may be indicated to the user by an audio signal, such as a sound, a sound sequence, or a spoken message, triggered by the users relay device 11. The audio signal may be emitted by the hearing aid 1 on a triggering command from the relay device 11 or by the relay device 11 itself. In the latter case the relay device 11 may be provided with a loudspeaker (not shown) for emitting the audio signal. If several Local Area Networks are present at the same time, the audio signal may reflect this, e.g. by the same signal being repeated a number of times corresponding to the number of Local Area Networks available or by consisting of different sounds in a number corresponding to the number of Local Area Networks available.

Once connected to a Local Area Network, information indicating the presence of other users on that specific Local Area Network may be presented to the user on the display 7 of the relay device 11. Alternatively or in addition to such visual presentation of the users present on the specific Local Area Network an audio presentation may also be given, for instance by the use of speech synthesis transmitted to the user over the hearing aid 1 or the relay device 11, or in a way similar to the indication of the presence of Local Area Network(s) as described above.

This allows the user to have an overview over the other hearing aid systems available for wireless communication over the wireless Local Area Network. Preferably, the relay device 11 allows for setting an intelligible identification of the hearing aid system, such as the user's name, allowing other users to readily identify the user. Alternatively, a control unit 8, such as a computer, could store intelligible names corresponding to unique identifiers of hearing aid systems, and keep track of potential participants currently available for or logged onto the wireless Local Area Network. This option is also illustrated in FIG. 1. The connection between the control unit 8 and the wireless router 10 of the Local Area Network 6 needs not be wireless, but could be via a cable connection 9.

Figure 3:
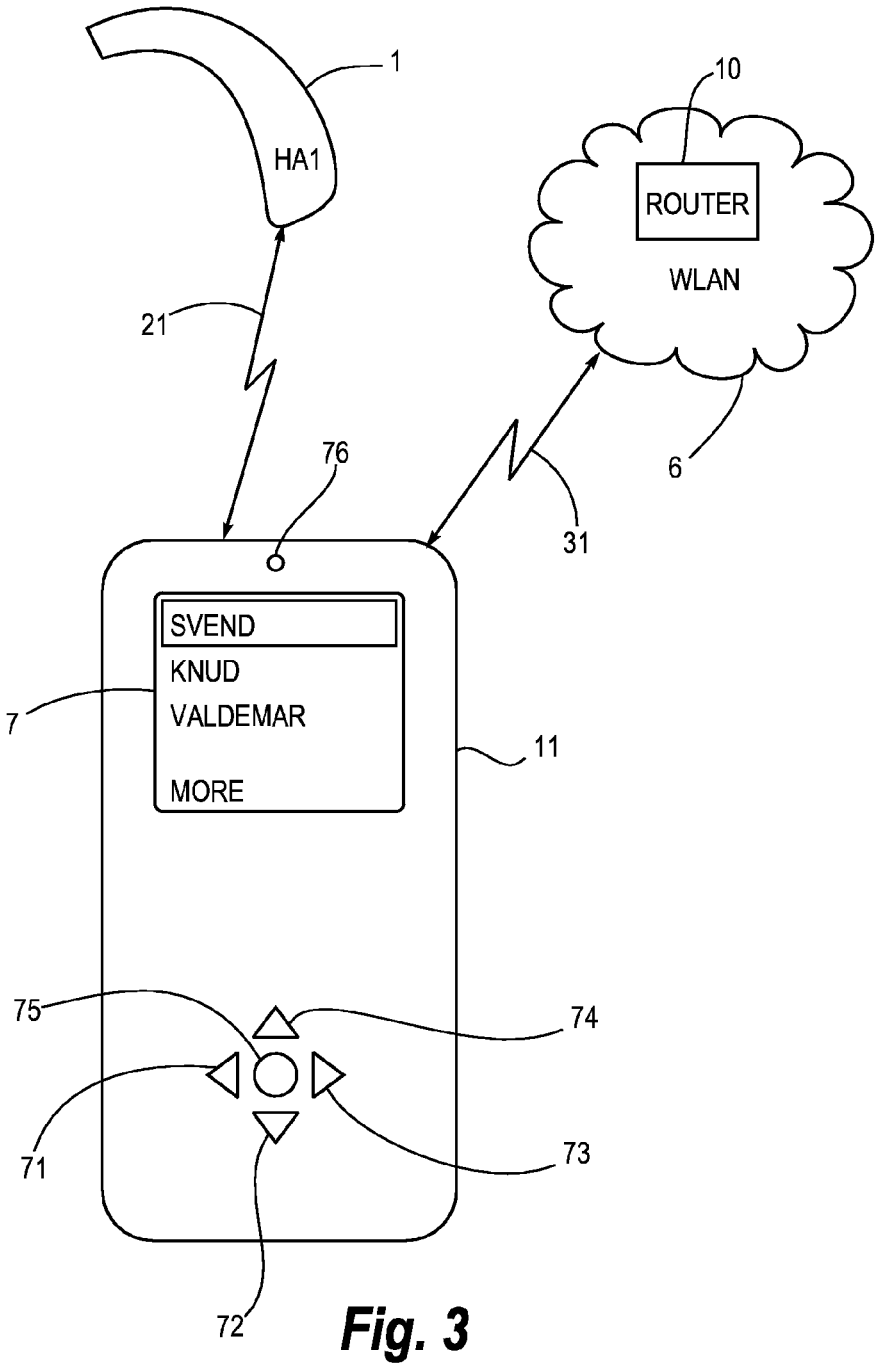
FIG. 3 schematically illustrates a hearing aid system as used in FIG. 1.

As illustrated in FIG. 3, the relay device 11 has identified inter alia three other hearing aid systems belonging to the persons Svend, Knud and Valdemar. These are selectable as participants for a personal conversation group. The selection may be done using push-buttons 71, 72, 73, 74, 75 in conjunction with a menu system on the display 7, allowing the user to navigate the menu. How this is done in detail is well within reach of the skilled person, and does not form part of the present invention. Thus, the skilled person would realise that an alphanumeric keypad, or a finger-touch screen, could be used for typing in things or navigating a menu.

Moreover, the skilled person would also realise that even though the focus of this invention is on the establishment of a conversation group, the display of other items on the display 7 is not excluded, in particular the display of other relevant devices on the wireless Local Area Network, such as auxiliary microphone units, or audio streaming devices. The establishment of the conversation group may simply be effected by two or more parties selecting each other's hearing aid systems upon mutual agreement. Alternatively, the selection of a desired participant may prompt a request on the display of that desired participant's relay device, which must then be confirmed before the conversation group is established.

Rather than indicating all other users on that specific Local Area Network 6 on the display 7 of the relay device 11, it may in many situations be advantageous to show only those other hearing aids systems present in the close vicinity of the hearing aid system in question. This could e.g. be the situation in an old people's home where many hearing aid users are likely to share the same wireless Local Area Network 6, irrespective of whether they are alone in their individual rooms or together with others in a recreational living room. Here other users not present in the recreational room or engaged in conversation at the other end of the room are unlikely to be interesting as partners for conversation, and hence for participation in a conversation group.

In this situation, the relay device 11 may include a proximity detector for the detection of other hearing aid systems, and identification thereof as likely participants to the conversation group. The proximity detector is set to include those systems closer than a pre-selected distance, e.g. 2-10 meters, preferably 3 meters.

One preferred way of achieving this is to include in the relay device 11 means for detecting the signal strength and an individual code transmitted between another hearing aid 2 and the associated relay device 12. This detection in conjunction with the presence on the wireless Local Area Network 6 would then reduce the number of available participants presented to the user on the display 7 of his relay device 11. Alternatively, the relay device 11 could be fitted with a transponder, or use a separate detection frequency.

Using proximity detection offers the possibility of automatic establishment of a conversation group with those other hearing aid systems present in the proximity of the hearing aid system. Thus if two or more hearing aid systems are in close proximity the conversation group could be automatically established without the intervention of the respective users. Though this may present advantages for the user, who in that case needs not learn how to navigate the conversation group facility of his hearing aid, it does present some drawbacks and is thus less preferred. One such drawback is the loss of privacy, when any passing hearing aid user gets an improved possibility of listening in on a conversation otherwise private. Also, if many hearing aid systems are close to each other, say people in a queue or at a cocktail party, the conversation group could expand in an undesired manner. That is to say, any participant in the conversation group might include further hearing aid systems in the conversation group, which in turn may include further participants, thus expanding the conversation group to a size where it becomes useless for improving communication, because there are too many participants.

The relay device 11 preferably also includes one or more microphones 76, e.g. directional microphones. This provides an extra capability for improving the communication, instead of relying solely on the built-in microphones of the hearing aid. Thus, if a hearing aid user positions his relay device 11 in front of and pointing towards a speaking person, this may improve his and other participants of the conversation group's ability to hear this speaking person, who may not be a hearing aid user himself. For the benefit of other hearing aid users he may also position the relay device 11 with the microphone 76 in front of and pointing towards himself. Using a directional microphone of the relay device 11 rather than the built-in microphone of his own hearing aid may give a better sound reception of his voice, i.e. a reception with less disturbing noise because of the directionality. These options are of course contingent on the provision that the relay device is not moved too far away from the associated hearing aid. This would also be important in the case, as mentioned earlier, where a person not using a hearing aid borrows a relay device 11, as the lender would otherwise not be able to receive communication from other participants.

Evidently, the sound can be picked up by the regular microphone of the hearing aid. Furthermore, if the hearing aid 1 is of the type comprising an additional microphone for picking up sounds in the ear canal, i.e. in the cavity between the earplug of the hearing aid 1 and the tympanic membrane, this additional microphone may be used in extremely noisy surroundings. In that case the speech of the hearing aid user is picked up in the ear canal, where it is shielded from ambient noise by inter alia the earplug of the hearing aid, and transmitted to the other participants in the conversation group via the relay device 11. Another possibility, which may be advantageous by reason of better suppression of ambient noise, is a microphone arranged to pick up sound in the ear canal, in front of the ear drum. A combination of microphones is also possible. For further explanation about arranging a microphone to pick up sound in the ear canal, reference may be had to WO-A1-00/28783, WO-A1-00/28784, and to U.S. Pat. No. 4,548,082.

Though the outset of the present invention has been to establish a conversation group among hearing aid users, in order to improve their intercommunication, the inclusion of other devices in the conversation group is not excluded. Thus, a microphone unit enabled for communication with a wireless Local Area Network could participate in the conversation group. This would e.g. allow the lecturer at a conference to address the hearing aid users using the conference room's wireless Local Area Network, instead of traditional FM systems. Also, in a private home with a hearing impaired child, the parents could use such a microphone unit enabled for communication with a wireless Local Area Network to communicate with their child via the wireless Local Area Network in the home. Such a microphone unit preferably also includes means for displaying and selecting hearing aid systems for participation in a conversation group. Likewise it would show up as a selectable participant on the displays 7 of relay devices 11 of hearing aid systems according to the invention, as indicated above.

If the wireless Local Area Network 6 is moreover connected to the internet, it would even be possible to use the hearing aid system to establish contact with other remote devices via the internet. Thus, the hearing aid 1 could be used as a head-set for IP telephony, if appropriate protocols are implemented, e.g. in the remote device 11 or on a computer connected to the wireless Local Area Network. The skilled person would know how to implement these protocols.

Turning now to FIG. 2, there is shown an alternative embodiment in which the relay devices 11, 12, 13, 14, 15 of different hearing aid systems are adapted for direct wireless inter-communication. The wireless communication could be any appropriate wireless communication, e.g. Bluetooth, as suggested for communication with a central computer in WO-A-2006/074655. WO-A-2006/074655, however, deals with the communication between the binaural hearings aids and a relay device, and does neither suggest any inter-communication between different hearing aid systems, nor any adaptation of such systems to allow direct inter-communication.

Similar to FIG. 1 two groups, indicated with interrupted lines, have been established. As can be seen, the relay devices 11, 12 associated with the two hearing aids 1, 2 have established a bi-directional communication 80 via a wireless connection, such as a Bluetooth connection, so as to form a private conversation group. Correspondingly the relay devices 13, 14, 15 associated with the three hearing aids 3, 4, 5, have established a private conversation group, independently of the relay devices 11, 12, using a number of bi-directional connections 81, 82, 83 such as Bluetooth.

Bluetooth provides a capability of automatically connecting to any device within transmission range, which is typically less than 10 meters. As an alternative, any Bluetooth device within the range may be detected and displayed on the relay device 11, thus offering the option of manual selection of participants to a conversation group to be established. Preferably, however, only relevant devices such as other hearing aids are displayed as selectable. This however does not exclude the display of other relevant devices, such as Bluetooth enabled microphone units, or audio streaming devices on the display 7.

We claim:

1. A hearing aid system comprising a hearing aid with an associated relay device, and adapted for establishing a conversation group with other hearing aid systems, said relay device being adapted for wireless communication with said hearing aid and for wireless communication with a second hearing aid system, said relay device having means for receiving and indicating information about other hearing aid systems available for participation in said conversation group, and said relay device comprising means for selection of said second hearing aid system for inclusion into said conversation group;

wherein said information about other hearing aid systems comprises information about a plurality of other hearing aid systems and wherein at least one of said other hearing aid systems is not selected by said means for selection.

2. The hearing aid system according to claim 1, comprising means for detecting the range to said second hearing aid system.

3. The hearing aid system according to claim 2, comprising means for automatically selecting said second hearing aid system for inclusion into said conversation group based on the range detection.

4. The hearing aid system according to claim 1, wherein said relay device is integrated in a remote control for operating the hearing aid.

5. The hearing aid system according to claim 1, wherein said means for receiving and indicating information about said other hearing aid systems comprises at least one of a display and a means for emitting an audio signal.

6. The hearing aid system according to claim 1, wherein said relay device is adapted for establishing wireless communication with a Local Area Network.

7. The hearing aid system according to claim 6, wherein said relay device comprises means for detecting and indicating the presence of said Local Area Network.

8. The hearing aid system according to claim 7, wherein said means for detecting and indicating the presence of said Local Area Network comprises at least one of a display and a means for emitting an audio signal.

9. A hearing aid system comprising a hearing aid with an associated relay device, and adapted for establishing a conversation group with other hearing aid systems, said relay device being adapted for wireless communication with said hearing aid and for wireless communication with a second hearing aid system, said relay device having means for receiving and indicating information about other hearing aid systems available for participation in said conversation group, and said relay device comprising means for selection of said second hearing aid system for inclusion into said conversation group, wherein said relay device is adapted for establishing wireless communication with a Local Area Network, said relay device comprising a means for indicating other hearing aid systems having established connections with said Local Area Network, and means for selection of such other hearing aid systems for inclusion into said conversation group.

10. The hearing aid system according to claim 9, wherein said means for indicating other hearing aid systems having established connection with said Local Area Network comprises at least one of a display and a means for emitting an audio signal.

11. The hearing aid system according to claim 1, wherein said relay device is adapted for establishing direct wireless communication with said second hearing aid system.

12. The hearing aid system according to claim 1, wherein said hearing aid comprises a microphone for picking up sounds in the ear canal of the user.

13. The hearing aid system according to claim 1, wherein said relay device comprises at least one built in micro-phone.

14. A method for establishing a conversation group between a hearing aid system comprising a hearing aid and an associated relay device and at least one other hearing aid system comprising the steps of:

detecting with said relay device the presence of said other hearing aid systems, available for participation in said conversation group, receiving in said relay device information about said other hearing aid systems, indicating said presence of said other hearing aid systems by the use of said relay device, and selecting, using said relay device, at least one of said other hearing aid systems for participation in said conversation group;

wherein said information about other hearing aid systems comprises information about a plurality of other hearing aid systems and wherein at least one of said other hearing aid systems is not selected by said selecting step.

15. A method for establishing a conversation group between a hearing aid system comprising a hearing aid and an associated relay device and at least one other hearing aid system comprising the steps of:

detecting with said relay device the presence of said other hearing aid systems, available for participation in said conversation group, receiving in said relay device information about said other hearing aid systems, indicating said presence of said other hearing aid systems by the use of said relay device, and selecting, using said relay device, at least one of said other hearing aid systems for participation in said conversation group, said method further comprising the steps of, using said relay device, detecting the presence of a Local Area Network, indicating said presence of said Local Area Network and selectively connecting to said Local Area Network.

16. The method according to claim 14, wherein said step of indicating the presence of said other hearing aid system comprises the really device triggering at least one of a visual signal and an audio signal.

17. The method according to claim 14, wherein said step of selecting at least one of said other hearing aid systems comprises selection based on a detected range to at least one of said other hearing aid systems.

18. The method according to claim 15, wherein said step of indicating the presence of said Local Area Network comprises the relay device triggering at least one of a visual signal and an audio signal.

19. The hearing aid system according to claim 1, wherein sound picked up by each hearing aid in said conversation group is wirelessly transmitted from the associated relay device to each other hearing aid in said conversation group.

20. The method according to claim 14, wherein sound picked up by each hearing aid in said conversation group is wirelessly transmitted from the associated relay device to each other hearing aid in said conversation group.

* * * * *